US006006966A

United States Patent [19]

Voisin, Jr.

[11] Patent Number: 6,006,966

[45] **Date of Patent: *Dec. 28, 1999**

[54] PAINT CAN HOLDER

[75] Inventor: Carroll J. Voisin, Jr., Houma, La.

[73] Assignee: V & M Corporation, Houma, La.

[ * ] Notice: This patent is subject to a terminal disclaimer.

[21] Appl. No.: 08/097,759

[22] Filed: Jul. 26, 1993

[51] Int. Cl.[6] ..... A45F 5/00

[52] U.S. Cl. ..... 224/148.4; 227/197; 227/666

[58] Field of Search ..... 224/148, 197, 224/253, 270, 148.1, 148.4, 148.7, 666

[56] References Cited

U.S. PATENT DOCUMENTS

| | | | |
|---|---|---|---|
| D. 276,760 | 12/1984 | Kesterson | D2/400 |
| 1,445,642 | 2/1923 | O'Neill | 224/148 |
| 2,717,109 | 9/1955 | Walsh . | |
| 2,753,094 | 7/1956 | Haney, Jr. | 224/197 |
| 2,995,281 | 8/1961 | Dixon . | |
| 3,876,125 | 4/1975 | Emmert | 224/148 |
| 4,172,542 | 10/1979 | Lankford | 224/148 |
| 4,325,503 | 4/1982 | Swinny | 224/148 |
| 4,433,801 | 2/1984 | Swinny | 224/148 |
| 4,527,720 | 7/1985 | Hayes | 224/148 |
| 5,016,791 | 5/1991 | Burow | 224/148 |
| 5,340,006 | 8/1994 | Li | 224/148.4 |

*Primary Examiner*—Renee S. Luebke
*Attorney, Agent, or Firm*—Roy, Kiesel & Tucker, PLC

[57] ABSTRACT

A can holder worn by a person comprising a can holding member having a rigid back plate and rigid support arms extending from the back plate to form a gap between the support arms of sufficient distance to allow a can's sidewalls to pass between the arms. The support arms have opposing notches sized to receive a can handle attachment members and where the notches are positioned to permit the can to pivot about the can handle attachment members; and a belt suspension member attachable to one end to a belt and pivotally attachable at its end opposite the back plate.

11 Claims, 6 Drawing Sheets

PAINT CAN HOLDER

FIELD OF THE INVENTION

The invention relates generally to paint-can holding devices and more particularly to paint-can holding devices that are suspended from a persons's belt, support the paint can from the paint-can's handle-attachment members and include pivoting means for keeping the paint can upright.

PRIOR ART

A paintbrush can only hold a fixed amount of paint at a time. It is therefore necessary, when painting with a paintbrush, to have a supply of paint accessible to the painter for replenishing the brush when required. This is often accomplished by placing a can of paint near the area being painted or holding a can of paint with one hand and painting with the brush in the other. Surfaces which are most efficiently painted by brush, such as trim work and molding, are often out of the way or hard to reach. In order to paint these areas it may be necessary to employ a ladder or some sort of scaffolding to provide a platform from which the painter may work. It is not always possible when working from one of these devices to have a convenient, stable surface to place the paint can on while painting. In the case of a ladder, painting with a paintbrush in one hand and a paint can, which can weigh up to 25 pounds, in the other hand can be a dangerous practice. If the painter were to momentarily lose his balance while painting this way, he would not have a free hand to grasp the ladder or some other nearby structure to steady himself. Also, the painter may want to paint a spot not so distant from the location of the ladder to require movement of the ladder; but for safety, the painter would like to hold onto something to steady himself. This can only be done if the painter has a free hand. The painter who has both hands filled while climbing on scaffolding or a ladder must choose between dropping either the paint can or the paintbrush or risk falling himself if he loses his balance. It is important therefore, for the safety of painter, as well as those persons working near the painter, that the painter have a free hand with which to balance himself or to grasp something to steady himself.

It is therefore desirable to have a device that will free the painter from holding the paint can while working in precarious positions and still provide ready access to the paint.

Additionally, when working with a paint can which is partially empty, the paint can may be accidently knocked over while wiping the bristles of the brush against the inside rim of the paint can during the paintbrush replenishing process. This occurs because the reduced amount of paint in the paint can does not weigh enough to keep the can upright against the horizontal force of the paintbrush. It is therefore desirable to have a device which will provide horizontal support to the paint can as well as vertical support.

Also, since the painter may be working for an extended period of time, it is also important and desirable that the device for holding the paint can be comfortable to wear as well as provide a location for the paint can that is readily accessible and allows the painter to comfortably replenish his paintbrush when necessary. In addition to the above mentioned desirable attributes of a device for holding a paint can, it also desirable that the device be adaptable for holding various sized paint cans, since paint is packaged in variously sized containers.

SUMMARY OF THE INVENTION

Therefore, it is an object of the present invention to provide a device for holding a can of paint in a readily accessible location for a painter.

It is another object of the present invention to provide a device for holding a can of paint which has means to prevent the can from tipping over and spilling its contents.

It is still another object of the present invention to provide a device for suspending a can of paint from a painter's belt.

It is still a further object of the present invention to provide a device which is adaptable for receiving and holding cans of varying standard sizes.

Accordingly, a paint-can holding device is described which is attachable to a person's belt and holds a paint can having a paint-can handle by opposing paint-can-handle attaching members extending from the exterior surface of the sidewalls of the paint can. The paint-can holding device comprises a can holding member having a rigid back plate member. The rigid back plate member is provided with rigid support arm members extending from a side thereof which are (i) spaced apart sufficiently to form an open paint-can receiving gap to receive the paint can, and (ii) are of sufficient length to extend beyond the opposing paint-can-handle attaching members of the paint can. The rigid support arm members are provided with can retention notches to receive the opposing paint-can-handle attaching members at a distance, sufficient to prevent the paint can from contacting the rigid back plate member, in a direction away from the rigid back plate member. The paint-can holder also comprises a means attachable to the belt which has a rigid vertical extension portion extending vertically downward when the means is attached to the belt. The rigid vertical extension portion is attached to the can holding member by a pivot member in a manner to allow the paint can to hang vertically and pivot about an axis that is perpendicular to the means.

PREFERRED EMBODIMENT OF THE INVENTION

Figure 1:
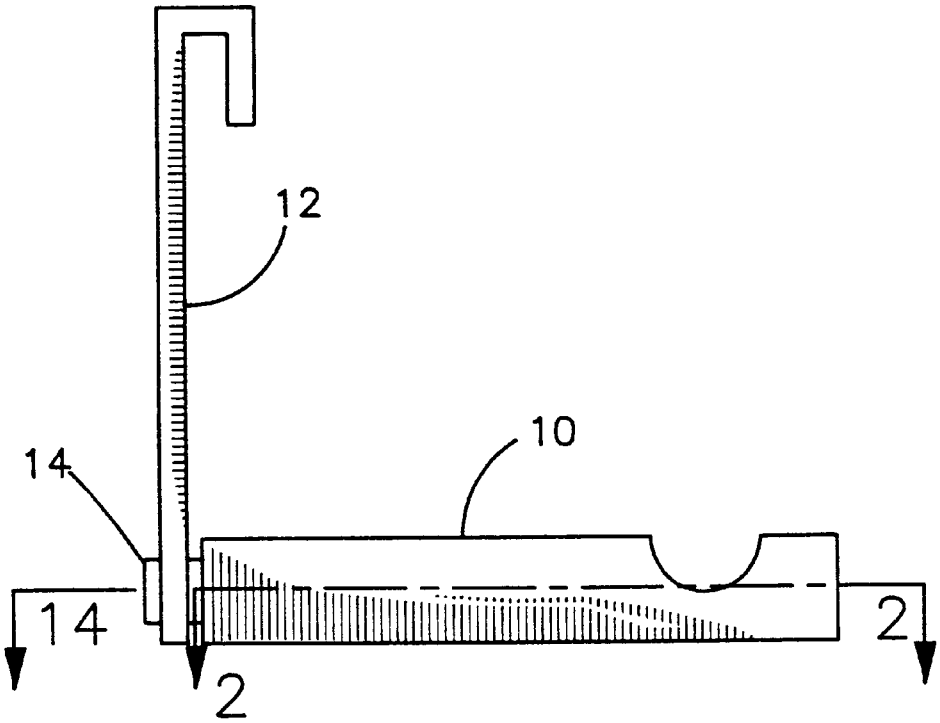
FIG. 1 is a side view of the device of the present invention.

FIG. 1 is a side view of the paint-can holder of the present invention. As seen in the figure, the paint-can holder of the invention comprises three main elements: a can holding member, generally indicated by the numeral 10; a belt suspension member, generally indicated by the numeral 12; and a pivot member, generally indicated by the numeral 14.

Figure 2:
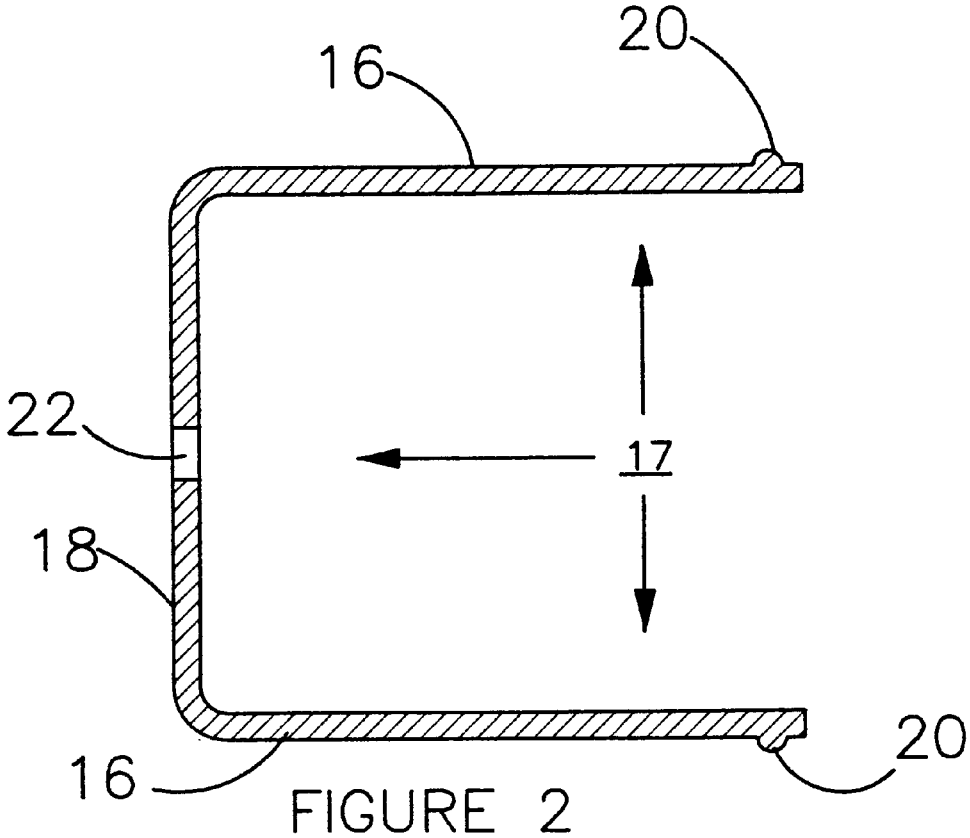
FIG. 2 is a sectional view of the device of the present invention along line 2—2.
Figure 3:
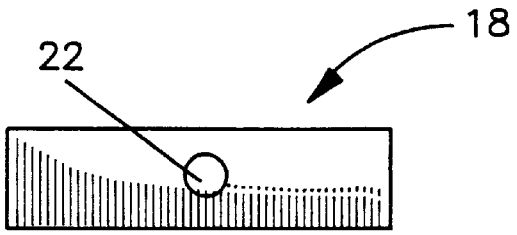
FIG. 3 is a rear view of the back plate of the can holding member of the device of the present invention.

FIG. 2 is a sectional view of can holding member 10 along line 2—2 of FIG. 1. Can holding member 10 includes two rigid can support arms 16 and rigid back plate 18. Rigid can support arms 16 extend from one side of rigid back plate 18 and are spaced a sufficient distance apart to form paint-can receiving gap 17. Rigid can support arms 16 are of sufficient length to extend past the center line of a paint can received within paint-can receiving gap 17 by at least a distance sufficient to allow the paint can to clear rigid back plate 18. Paint-can-handle retention knobs 20 are located near the end of each rigid can support arm farthest from rigid back plate 18 on the side opposite paint-can receiving gap 17 and positioned to permit handle 103 to be deformably snapped past retention knobs 20. Located between rigid can support arms 16 and through rigid back plate 18 is back plate pivot hole 22 which is more clearly seen in the rear view of rigid back plate 18 illustrated in FIG. 3.

Figure 4:
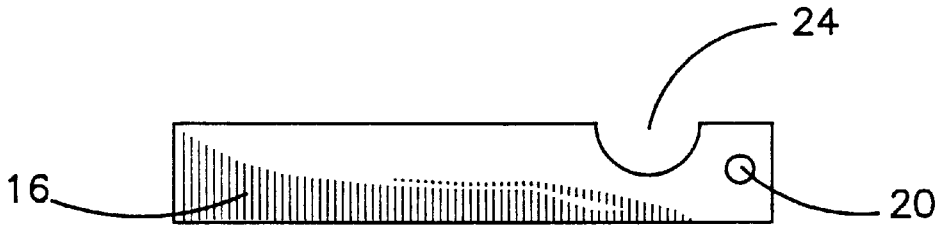
FIG. 4 is a side view of a rigid can support arm of the device of the present invention.

FIG. 4 is a side view of one of rigid can support arms 16. It shows can retention notch 24 which is of sufficient depth and width to receive the paint-can-handle attachment members located on the side of a paint can near the rim. Can retention notches 24 are located a sufficient distance from rigid back plate 18 to allow a paint can to be secured within paint-can receiving gap 17. In a preferred embodiment can retention notches 24 are arcuate in shape with a radius of about five-eighths of an inch.

Figure 5:
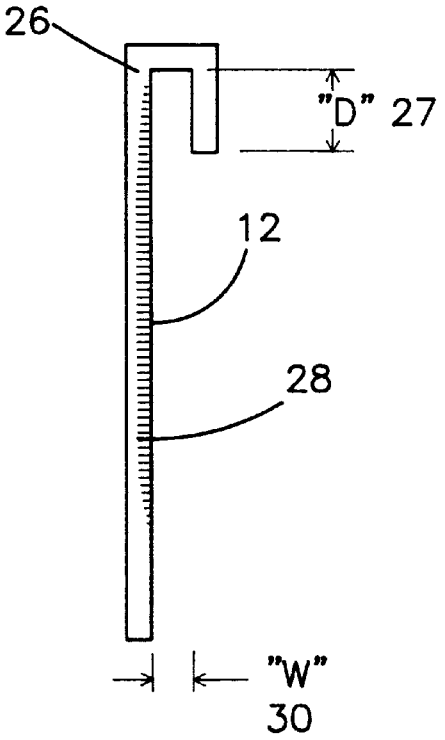
FIG. 5 is a side view of the belt suspension member of the device of the present invention.
Figure 14:
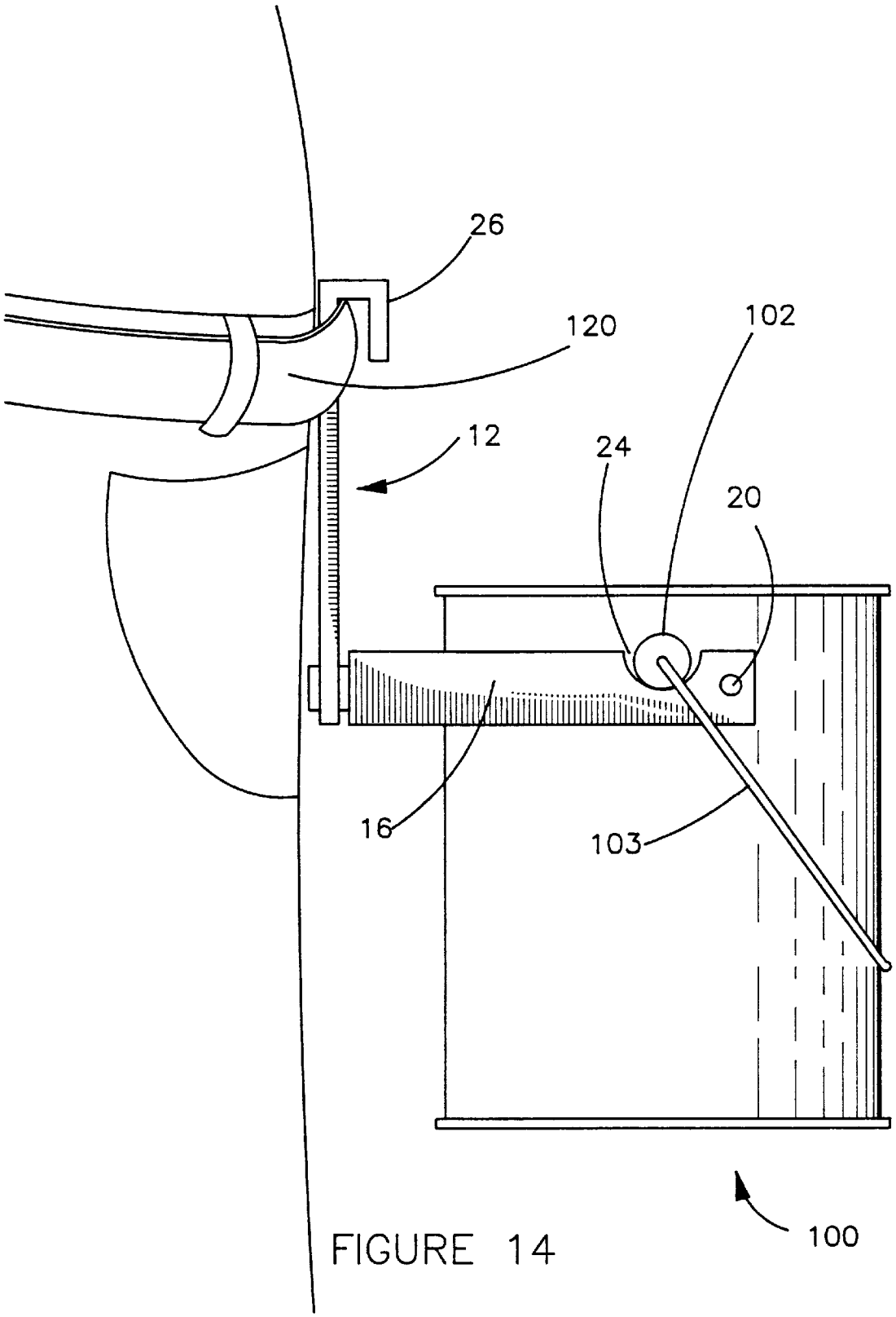
FIG. 14 is a side view of the device of the present invention in connection with a representative paint can and belt.

Can holding member 10 is constructed of a material having sufficient rigidity to support the weight of a full paint can without becoming inoperatively deformed. Inoperatively deformed in this context means bent out of shape to such an extent that a paint can is not supportable by the device or that can holding member 10 will not pivot with respect to belt suspension member 12. In a preferred embodiment rigid can support arms 16 and rigid back plate 18 are integrally formed from inch and a quarter wide by eighth inch thick bar stock. A side view of belt suspension member 12 is shown in FIGS. 5 and 14. Belt suspension member 12 comprise a belt hook section 26 and a vertical extension section 28. Belt hook section 26 has belt receiving gap 30 which is dimensioned for receiving the painter's belt therein. In a preferred embodiment belt hook section 26 is shaped to form a belt passageway 27 having a gap 30 to permit belt 120 to be positioned in belt passageway 27. More preferably, both belt passageway 27 and belt receiving gap 30 has a width "W" of about a quarter of an inch and belt passageway 27 has a depth "D" of about an inch.

Figure 6:
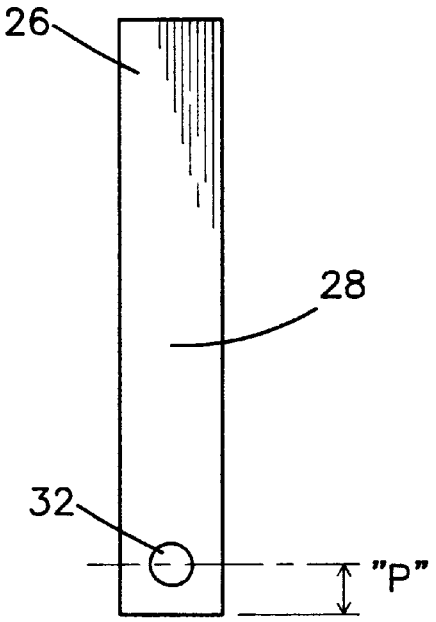
FIG. 6 is a rear view of the belt suspension member of the device of the present invention.

As shown in FIG. 6 vertical extension portion 28 includes cylindrical pivot hole 32 located toward the end farthest from belt hook section 26 for receiving a section of pivot member 14. The length of vertical extension section 28 and the distance "P" of cylindrical pivot hole 32 from the far end of vertical extension portion 28 are selected to vertically position can holding member 10, and thereby the paint can received therein, at a comfortable level for the painter. In a preferred embodiment the length of vertical extension section 28 is selected to be about eight inches and the distance "P" is selected at about five-eighths of an inch when the preferred dimensions of the belt passageway are used. This places pivot hole 32 about six to seven inches from gap 30.

Belt suspension member 12 is constructed of a material having sufficient rigidity to support the weight of a full paint can without becoming inoperatively deformed. In a preferred embodiment belt hook section 26 and vertical extension section 28 are integrally formed from inch and a quarter wide by eighth inch thick bar stock.

Figure 8:
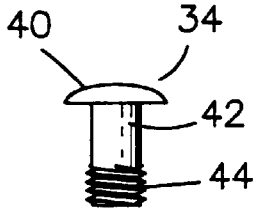
FIG. 8 is a side view of the pivot pin of the pivot member of the device of the present invention.
Figure 9:
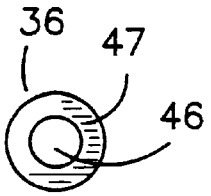
FIG. 9 is a top view of the spacer of the pivot member of the device of the present invention.
Figure 10:
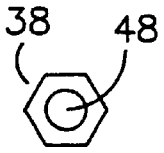
FIG. 10 is a top view of the pivot pin securing device of the pivot member of the device of the present invention.
Figure 7:
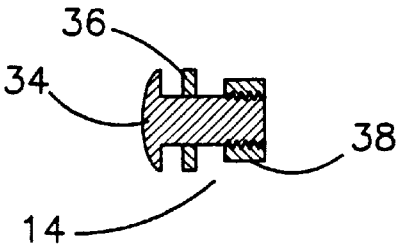
FIG. 7 is a side view of the pivot member of the device of the present invention.

Pivot member 14, comprises any fastening hardware, such as nut and bolt combinations or rivets, which will fasten can holding member 10 and belt suspension member 12 while allowing can holding member 10 to pivot about an axis perpendicular to belt suspension member 12. A preferred embodiment of pivot member 14 comprising pivot pin 34, spacer 36 and pivot pin securing portion 38, is illustrated in FIG. 7. FIG. 8 is a side view of pivot pin 34 of the preferred embodiment of the invention showing cap portion 40, cylindrical pivot shaft 42 and connecting end 44. The diameter of cap portion 40 is selected to be greater than the diameter of cylindrical pivot hole 32 of vertical extension portion 28. The diameter of cylindrical pivot shaft 42 is selected to allow the insertion and of cylindrical pivot shaft 42 through back plate pivot hole 22 and cylindrical pivot hole 32 and the rotation of cylindrical pivot shaft 42 while therein. A top view of spacer 36, illustrating spacer hole 46 and one of spacer sliding surfaces 47, is shown in FIG. 9. Spacer hole 46 has a diameter sufficient to allow cylindrical pivot shaft 42 to pass therethrough. The length of cylindrical pivot shaft 42 is sufficient to allow connecting end 44 to securingly engage pivot pin securing portion 38 while cylindrical pivot shaft 42 is inserted through spacer hole 46, back plate pivot hole 22, and cylindrical pivot hole 32. A top view of pivot pin securing portion 38 is shown in FIG. 10. Pivot pin securing portion 38 includes means for securely connecting with connecting end 44 of pivot pin 34. Pivot pin 34 and pivot pin securing portion 38 are constructed of a material having sufficient rigidity to support the weight of a full paint can without becoming inoperatively deformed.

In a more preferred embodiment pivot pin securing portion 38 includes threaded engagement bore 48 which is companionately threaded with connecting end 44 of pivot pin 34. In another preferred embodiment pivot pin 34 and pivot pin securing portion 38 are a companiately threaded one-half inch nut and bolt assembly.

Spacer sliding surfaces 47 must be sufficiently smooth to allow rigid back plate 18 to pivot with respect to belt suspension member 12 when the paint-can holding device of the invention is in use. In a preferred embodiment spacer 36 is a metal washer having an outer diameter of about one and one-eighth inches and having a hole therethrough with a diameter of about seven-sixteenths of an inch.

Figure 11:
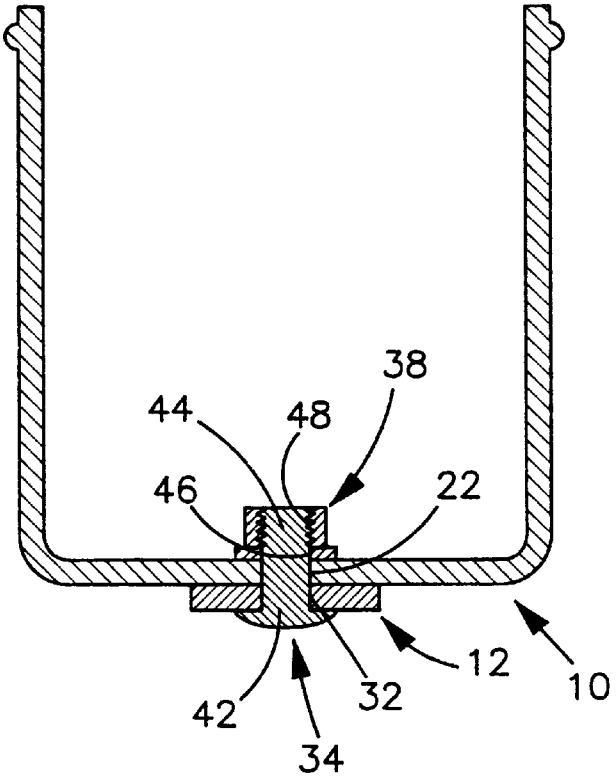
FIG. 11 is a slightly exploded, sectional view of the paint-can holder of the invention along line 14-2 of FIG. 1.

The assembly of a preferred embodiment of the paint-can holder of the present invention is illustrated by FIG. 11, a slightly exploded, sectional view of the paint-can holder of the invention along line 14-2 of FIG. 1. Cylindrical pivot shaft 42 of pivot pin 34 is passed sequentially through cylindrical pivot hole 32, back plate pivot hole 22 and spacer hole 46. Internally threaded cylindrical engagement bore 48 of pivot pin securing portion 38 is then threaded onto threaded end 44 of cylindrical pivot shaft 42 a sufficient amount to connect belt suspension member 12 and can holding member 10 and allow them to rotate about cylindrical pivot shaft 42.

Figure 12:
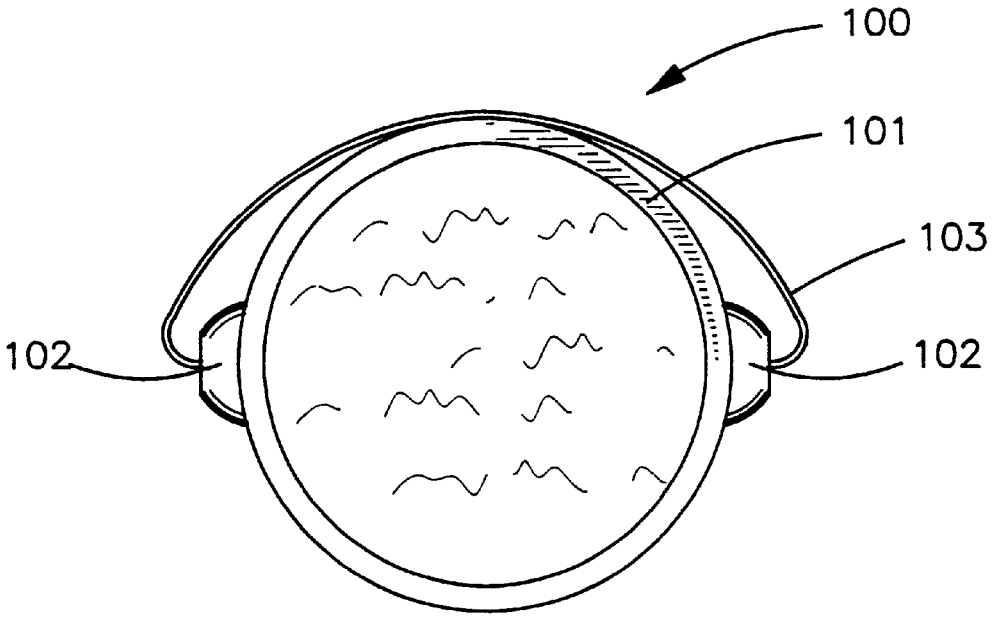
FIG. 12 is a top view of a representative paint can suitable for use with the device of the present invention.
Figure 13:
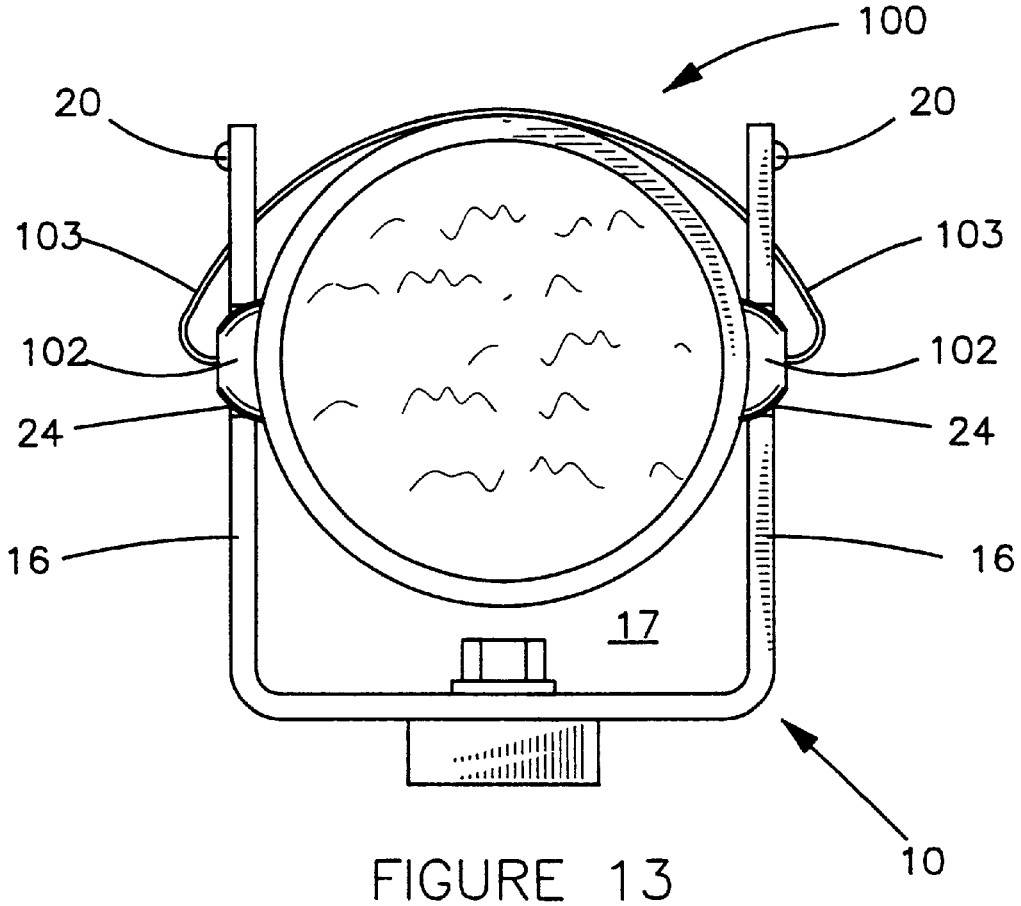
FIG. 13 is a top view of a representative paint can in connection with the device of the present invention.

FIG. 12 is a top view of a representative paint can 100 and shows paint-can rim 101, two paint-can-handle attaching members 102 and paint-can handle 103. A top view of the paint-can holder of the invention in connection with paint can 100 is shown in FIG. 13. Paint can 100 is received within paint-can receiving gap 17 of can holding member 10 and paint-can-handle attaching members 102 are secured within can retention notches 24 of rigid can support arms 16. Paint-can handle 103 is pulled over the ends of rigid can support arms 16 and held in place by paint-can-handle retention knobs 20. FIG. 14 is a side view of the paint-can holder of the invention with belt hook section 26 of belt suspension member 12 hooked to belt 120. Also illustrated is a side view of one paint-can-handle attachment member 102 received within can retention notch 24 of a rigid can support arm 16; and paint-can handle 103 positioned over the ends of rigid can support arms 16 and retained in place by one of paint-can-handle retention knobs 20.

In use, belt hook section 26, with belt receiving gap 30 facing away from the painter, is slipped between the painter and his belt until the tip of belt hook section 26 clears the belt. The painter's belt is then inserted within belt receiving gap 30. Once the paint-can holder is attached to the belt a paint can is then place within paint-can receiving gap 17 and its paint-can-handle attachment members positioned within can retention notches 24. The painter now has a ready supply of paint for replenishing his brush.

Figure 15:
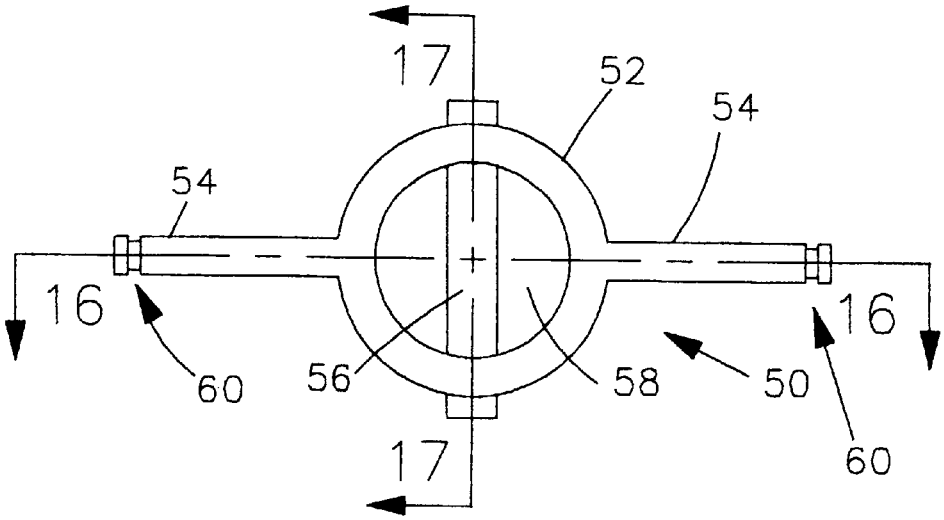
FIG. 15 is a top view of the adaptor member of the device of the device of the present invention.
Figure 16:
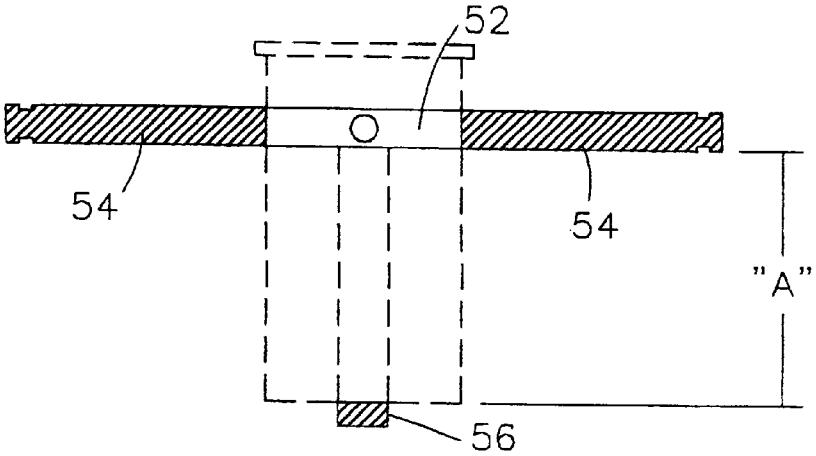
FIG. 16 is a sectional view of the adaptor of FIG. 15 along line 16—16.
Figure 17:
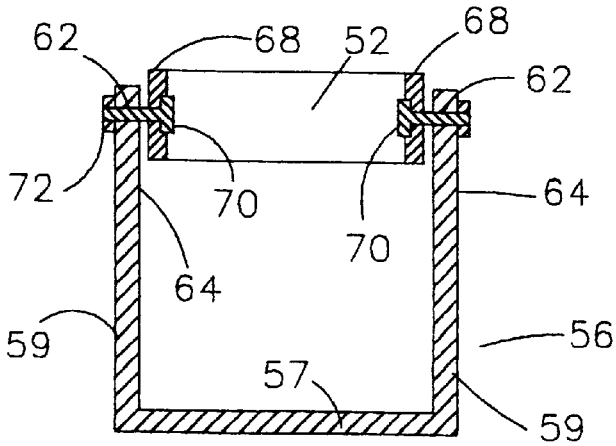
FIG. 17 is a sectional view of the adaptor of FIG. 15 along line 17—17.

In a more preferred embodiment of the invention, an adaptor or adaptors for adapting the paint-can holder to smaller diameter paint cans is/are included. A top view of an adaptor, generally indicated by the numeral 50, is shown in FIG. 15. Adaptor 50 includes can holding ring 52, two ring support arms 54 and adaptor can support 56. Can holding ring 52 has can receiving gap 58 which is dimensioned to allow a paint can of the selected size to fit therein. The ring support arms 54 are attached to the outer perimeter at opposed sides of can holding ring 52 and extend in a direction away from can holding ring 52 a sufficient distance to allow securing notches 60 located at the distal ends of ring support arms 54 to engage both can retention notches 24 of rigid can support arms 16. Adaptor can support 56 having a horizontal portion 57 and at least one vertical portion 59. Vertical portion 59 is attached at one end to the outer perimeter of can holding ring 52 and extends, in a direction perpendicular to ring support, arms 54, a sufficient distance "A" to allow attachment of horizontal portion 57 at an operative level. An operative level being a distance "A" sufficient to support and position the lip of the desired size paint can above can holding ring 52, as illustrated in FIG. 16. Horizontal portion 57 provides vertical support for the paint can and is connected with at least one vertical portion 59 at an operative level. FIG. 17, a sectional view of the adaptor along line 17—17 of FIG. 15, shows a preferred embodiment of adaptor can support 56 and a preferred mode of attaching it to can holding ring 52. In this preferred embodiment, adaptor can support 56 has two vertical portions 59. Each vertical portion 59 has can support bores 62 through its ends 64; can holding ring 52 has ring bores 66 through side wall 68 at opposite sides. Threaded bolts 70 are passed through can support bores 62 and ring bores 66 and secured with companionately threaded nuts 72.

There are of course other alternate embodiments which are obvious from the foregoing descriptions of the invention which are intended to be included within the scope of the invention as defined by the following claims.

What I claim is:

1. A holder attachable to a belt worn by a person to hold a can having a sidewall, a bottom and a removable top lid to form a liquid containing chamber and having attaching means protruding from opposite sides of said sidewall to which a handle is pivotally attached, said holder comprising:

(a) a can holding member comprising:
  (i) a rigid back plate, and
  (ii) rigid support arms extending from said back plate to form a gap between said support arms of sufficient distance to allow said can sidewall to pass between said arms, said support arms having opposing notches sized to receive said attaching means and positioned on said support arms to permit said can to pivot about said attaching means when said attaching means are received in said opposing notches; and (b) a belt suspension member having two ends, said first end of said belt suspension member being attachable to said belt and said second end of said belt suspension member being pivotally attachable to said back plate.

2. A holder according to claim 1 wherein said back plate and support arms are integrally formed into a U-shape from bar stock.

3. A holder according to claim 1 wherein each of said notches are formed from arcuate shaped, smooth surfaces in said support arms to receive said attaching means.

4. A holder according to claim 1 wherein a retention knob extends outward from one end of at least one of said support arms opposite said gap a distance sufficient to permit said handle to be deformably snapped past said retention knob.

5. A holder according to claim 1 wherein said belt suspension member has a belt hook section and a vertical extension section.

6. A holder according to claim 5 wherein a first end area of said vertical extension section and said belt hook section are shaped to form a passageway having a belt-shaped cross-section sized to receive a cross-section of said belt through an opening formed between said first end area of said vertical extension section and said belt hook section, said opening facing an opposite end area of said vertical extension section.

7. A holder according to claim 6 wherein said back plate is pivotally attached to said opposite end area of said vertical extension section a distance of about 6 to 7 inches from said opening.

8. A holder according to claim 1 wherein said holder comprises an adaptor means pivotally mountable in said notches, for holding a smaller can whose attaching means are separated a length less than said distance between said notches.

9. A holder according to claim 8 wherein said adaptor means comprises a can holding ring having a can receiving passageway sized to permit said smaller can to pass through said can receiving passageway, and having opposing, outwardly projecting, rigid, ring support arms whose length is sufficient to be received into said notches.

10. A holder according to claim 9 wherein said adaptor means further comprises an adaptor can support means to retain said smaller can within said can receiving passageway.

11. A holder according to claim 10 wherein said adaptor can support means comprises a horizontal member attached to said ring in a manner to be extend at least partially across said can receiving passageway at a position below said passageway to position said smaller can in said can receiving passageway.

* * * * *